United States Patent [19]

Eylon et al.

[11] Patent Number: 4,808,249

[45] Date of Patent: Feb. 28, 1989

[54] METHOD FOR MAKING AN INTEGRAL TITANIUM ALLOY ARTICLE HAVING AT LEAST TWO DISTINCT MICROSTRUCTURAL REGIONS

[75] Inventors: Daniel Eylon, Dayton; Francis H. Froes, Xenia, both of Ohio

[73] Assignee: The United States of America as represented by the Secretary of the Air Force, Washington, D.C.

[21] Appl. No.: 198,800

[22] Filed: May 6, 1988

[51] Int. Cl.[4] ..... C21D 1/00

[52] U.S. Cl. ..... 148/133; 148/11.5 F; 148/12.7 B; 419/23; 419/29

[58] Field of Search ..... 148/12.7 B, 11.5 F, 148/133; 419/29, 23

[56] References Cited

U.S. PATENT DOCUMENTS

| | | | |
|---|---|---|---|
| 2,892,742 | 6/1959 | Zwicker et al. | 148/11.5 |
| 4,381,942 | 5/1983 | Blum et al. | 419/23 |
| 4,415,375 | 11/1983 | Lederich et al. | 148/11.5 |
| 4,505,764 | 3/1985 | Smickley et al. | 148/133 |
| 4,534,808 | 8/1985 | Eylon et al. | 148/133 |
| 4,612,066 | 9/1986 | Levin et al. | 148/133 |
| 4,680,063 | 7/1987 | Vogt et al. | 148/133 |
| 4,714,587 | 12/1987 | Eylon et al. | 148/133 |

OTHER PUBLICATIONS

Kerr et al., "Hydrogen as an Alloying Element in Titanium (Hydrovac)", Titanium '80 Science and Technology, 1980, pp. 2477–2486.

*Primary Examiner*—Upendra Roy

*Attorney, Agent, or Firm*—Charles E. Bricker; Donald J. Singer

[57] ABSTRACT

A method for producing an integral titanium alloy article having at least two regions, each region having a distinct microstructure is provided. The method comprises heat treating one or more selected region(s) of the article at a temperature greater than the beta-transus temperature of the region(s), while simultaneously heat treating the remaining region(s) of the article at a temperature below the beta-transus temperature of the remaining region(s).

16 Claims, 2 Drawing Sheets

METHOD FOR MAKING AN INTEGRAL TITANIUM ALLOY ARTICLE HAVING AT LEAST TWO DISTINCT MICROSTRUCTURAL REGIONS

RIGHTS OF THE GOVERNMENT

The invention described herein may be manufactured and used by or for the Government of the United States for all governmental purposes without the payment of any royalty.

BACKGROUND OF THE INVENTION

This invention relates to a method for producing an integral titanium alloy article having at least two regions, each region having a distinct microstructure and mechanical properties.

The high strength-to-density ratio of titanium makes it a very attractive desiqn choice in energy-efficient high thrust-to-weight gas turbine engines or airframes of modern airlanes. In titanium, the alloying elements tend to stabilize either the low-temperature close-packed hexagonal alpha phase, or the higher temperature allotrope, body-centered cubic beta phase. Titanium alloys for aerospace applications contain both alpha and beta stabilizing elements in various proportions depending on the application and, therefore, the required mechanical properties. The variety of compositions in titanium alloys arises in part because certain alloys are designed for optimization of certain properties. For example, for short-term strength, a relatively high beta stabilizer content is required, while for long-term creep strength, a relatively higher alpha stabilizer content is required.

The important high-temperature properties for aerospace related applications of titanium alloys are: tensile strength, creep, fatigue initiation and fatigue crack propagation resistance. fracture toughness, hot salt stress and corrosion cracking, and oxidation resistance. In addition to selection of an alloy composition, processing of an alloy can be employed to provide desired properties.

In near-alpha and alpha+beta titanum alloys, the creep strength may be increased by heat treating or processing the material above the beta transus temperature. On cooling, this results in a lenticular alpha structure. This morphology has high creep strength, but has low low-cycle fatigue strength and low fatigue crack initiation resistance. On the other hand, an equiaxed alpha structure, such as resulting from sub-transus hot working and subsequent heat treatment, both in the alpha+beta phase field, exhibits lower creep resistance, but has high low-cycle fatigue strength and high fatigue crack initiation resistance. Thus, while it is possible to alter the microstructure of a titanium alloy article to obtain one or more desirable mechanical properties, such alteration often results in a diminution of one or more other mechanlcal properties. For example, a turbine rotor blade comprising an integral keyed configuration for mounting the blade within a matching slot on the periphery of a rotor may require creep resistance in the airfoil portion and high fatigue strength in the mounting portion. If such a turbine airfoil is heat treated to provide high creep resistance in the blade portion, it will likely have low fatigue strength in the mounting portion. Alternatively, if the blade is heat treated to provide high fatigue strength in the mounting portion, the airfoil portion will likely exhibit low creep strength.

Accordingly, it is an object of the present invention to provide a method for producing titanium alloy articles having both creep and low cycle fatigue resistance.

Other objects of the invention will be apparent to those skilled in the art from a reading of the following description of the invention.

SUMMARY OF THE INVENTION

In accordance with the present invention, there is provided a method for producing an integral titanium alloy article having at least two regions, each region having a distinct microstructure, which comprises heat treating one or more selected region(s) of the article at a temperature greater than the beta-transus temperature of the region(s), while simultaneously heat treating the remaining region(s) of the article at a temperature below the beta-transus temperature of the remaining region(s).

In a first embodiment of the invention, the article is fabricated using powder metallurgy techniques and heat treated.

In a first aspect the method of this invention comprises the steps of:

(a) providing a suitable mold for the article;

(b) introducing a first, non-hydrogenated titanium alloy in powder form into a first portion of the mold:

(c) introducing a second, hydrogenated titanium alloy in powder form into a second portion of the mold;

(d) hot compacting the first and second alloys in the mold to produce a substantially fully dense article; and (e) heating the resulting article to a temperature between the beta-transus temperatures of the two alloys.

In a second aspect the method of this invention comprises the steps of:

(a) providing a suitable mold for the article;

(b) introducing a first, non-hydrogenated titanium alloy in solid form into a first portion of the mold;

(c) introducing a second, hydrogenated titanium alloy in powder form into a second portion of the mold;

(d) hot compacting the first and second alloys in the mold to produce a substantially fully dense article; and (e) heating the resulting article to a temperature between the beta-transus temperatures of the two alloys.

In a second embodiment of the invention, the article is fabricated using any known technique and heat treated.

In a first aspect the method of this invention comprises the steps of:

(a) providing a titanium alloy article;

(b ) masking one or more selected region(s) of the article using a masking material impervious to the passage of hydrogen therethrough;

(c) hydrogenating the thus-masked article to a desired level of hydrogen; and, (d) heating the thus-hydrogenated article to a temperature between the beta-transus temperature of the hydrogenated region(s) and the beta-transus temperature of the non-hydrogenated region(s).

In a second aspect the method of this invention comprises the steps of:

(a) providing a titanium alloy article;

(b) hydrogenating the article to a desired level of hydrogen;

(c) locally heating one or more selected region(s) of the article to a temperature above the beta-transus temperature of the thus-hydrogenated article; and, (d) simultaneously heating the remainder of the thus-hydrogenated article to a temperature below the beta-transus temperature of the thus-hydrogenated article.

DETAILED DESCRIPTION OF THE INVENTION

Figure 2:
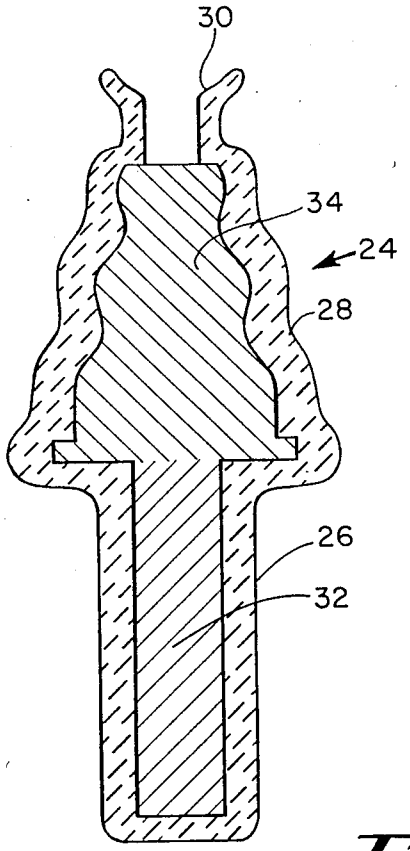
FIG. 2 is a cross-section through a mold for producing the blade shown in FIG. 1.
Figure 1:
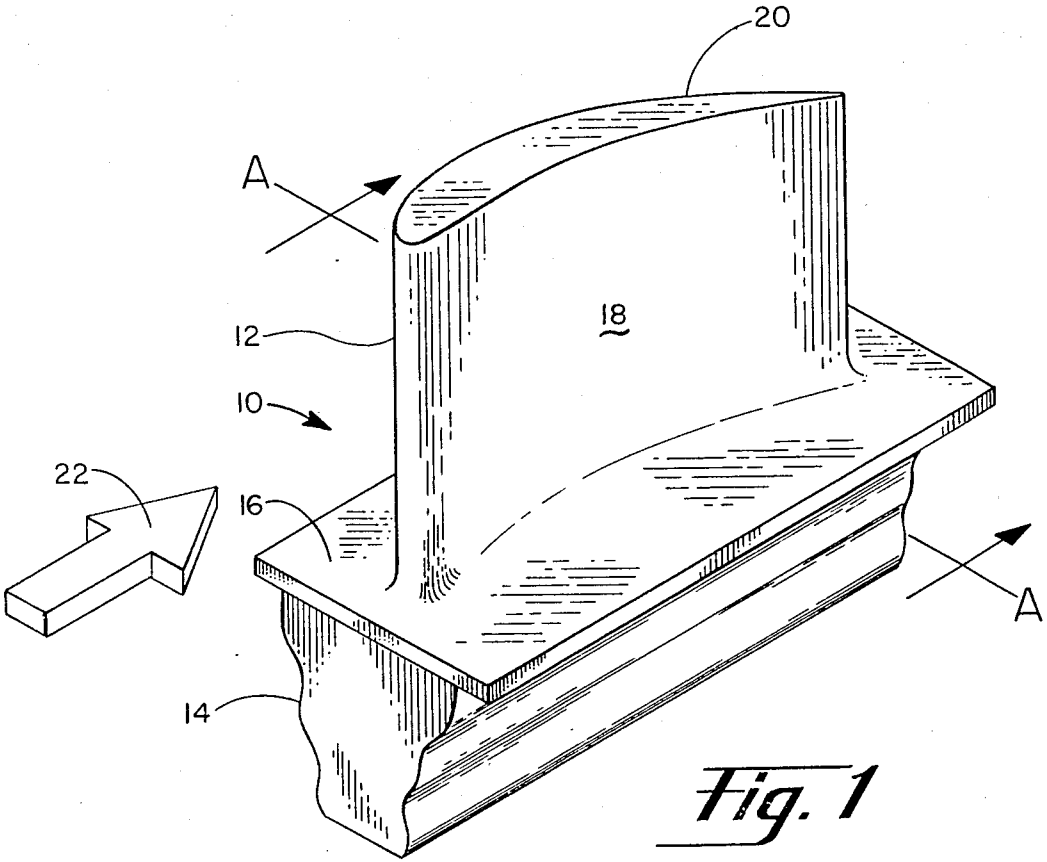
FIG. 1 is a perspective view of a turbine rotor blade.
Figure 3:
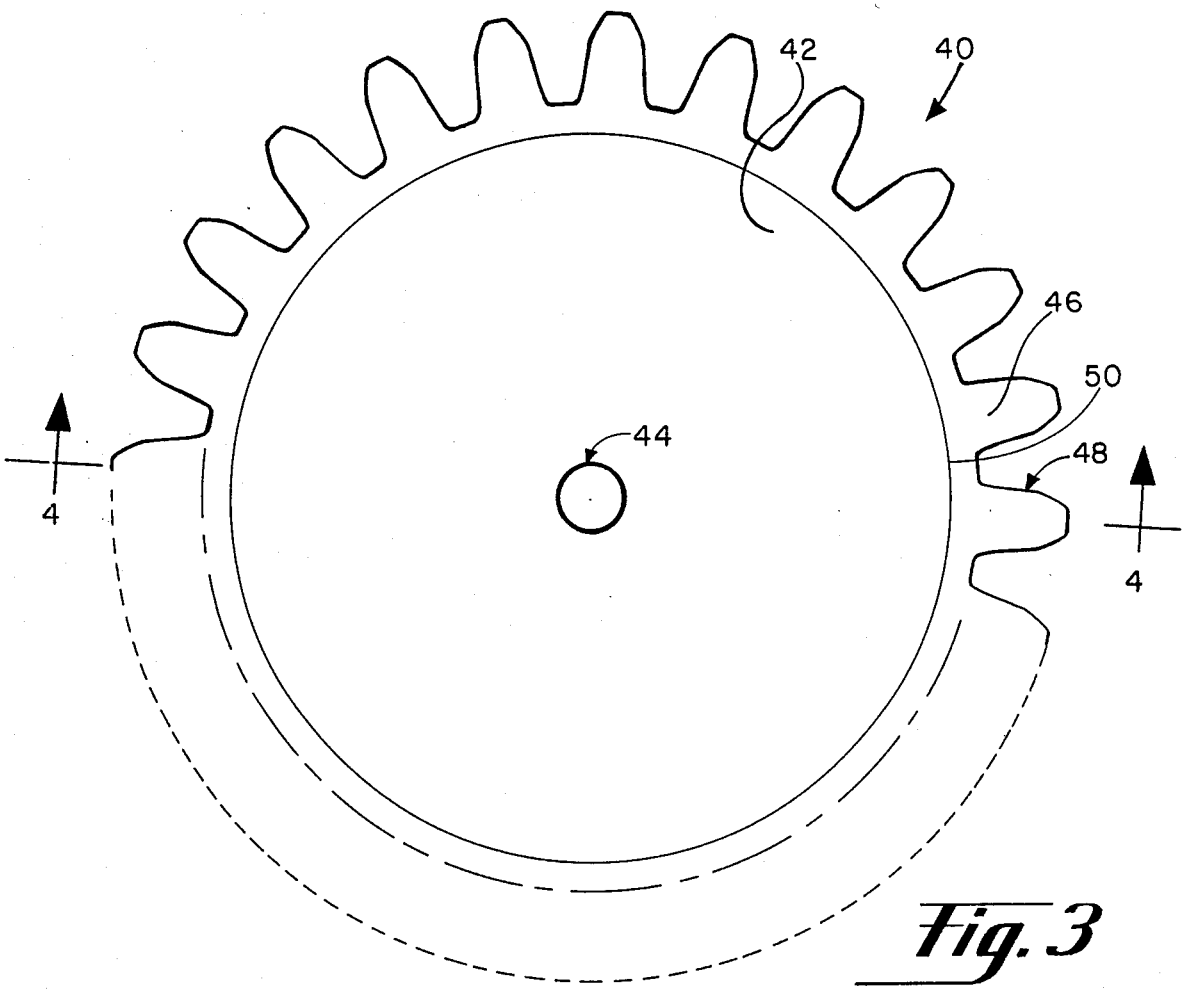
FIG. 3 is a top-view of a gear wheel.
Figure 4:
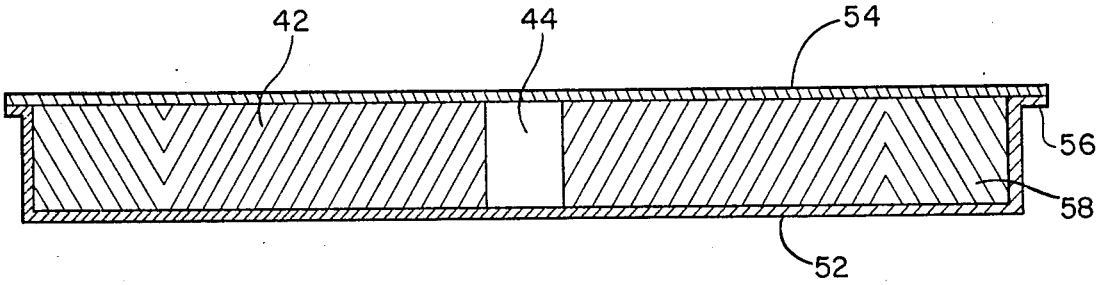
FIG. 4 is a cross-section through a mold for producing the gear shown in FIG. 3.

As discussed previously, the present invention provides a method for producing an integral titanium alloy article having at least two regions. each region having a distinct microstructure. The method of this invention may be employed to fabricate simple shapes such as gear wheels, as shown in FIGS. 3 and 4, as well as more complex shapes, such as turbine rotor blades, as shown in FIGS. 1 and 2. turbine compressor wheels with integral blades, pump impeller wheels and the like. Referring now to the drawing, FIG. 1 illustrates a rotor blade 10 comprising an airfoil blade portion 12 and a mounting portion 14. Mounting portion 14 may be a dovetail, as illustrated, fir tree or other keyed configuration for mating within a matching slot on the periphery of a rotor (not shown) of a turbine. Mounting portion 14 includes a platform 16 supporting blade portion 12. Blade portion 12 presents a pressure surface 18 and a suction surface 20 to the flow of fluids through the turbine, represented schematically by the arrow 22.

Referring to FIG. 2, the blade 10 is fabricated in accordance with the invention by first providing a suitable mold 24. The mold may be a metal can, ceramic mold or a fluid die mold. The ceramic mold process relies basically on the technology developed by the investment casting industry, in that molds are prepared by the lost-wax process. In this process, wax patterns are prepared as shapes intentionally larger than the final configuration. This is necessary because in powder metallurgy a large volume difference occurs in going from the wax pattern (which subseguently becomes the mold) to the consolidated compact. Knowing the configuration aimed for in the compacted shape, allowances can be made using the packing density of the powder to define the required wax pattern shape.

In the metal can technique, a metal can is shaped to the desired configuration by state-of-the-art sheet metal methods, e.g., brake bending, press forming, spinning, superplastic forming, etc. The most satisfactory container appears to be carbon steel, which reacts minimallY with the titanium, forming titanium carbide when then inhibits further reactions. Fairly complex shapes have been produced by this technique. Allowance for packing of the powder is incorporated into the metal can dimensions, just as for the ceramic mold.

In the present example, the mold 24 is a ceramic mold. It should be understood that the mold shown in FIG. 2 does not include allowance for packing of the alloy powders used.

Mold 24 comprises an airfoil blade cavity portion 26, a mounting cavity portion 28 and a filling opening 30. For purposes of illustration, Ti-6Al-4V powder 32, hydrogenated to about 0.5 to 1.5 weight percent hydrogen, is introduced into mold 24 in an amount sufficient to fill the blade cavity portion 26. The remainder of the mold 24 is then filled with non-hydrogenated Ti-6Al-4V powder 34.

In the metal can and ceramic mold processes, the powder-filled mold is supported in a secondary pressing medium contained in a collapsible vessel, e.g., a welded metal can (not shown). Following evacuation and elevated-temperature outgassinq, the vessel is sealed, then placed in an autoclave or other apparatus capable of hot isostatically compressing the vessel. Consolidation of the titanium alloy powder is accomplished by applying a pressure of at least about 10 ksi, preferably at least about 30 ksi, at a temperature of about 450 to 1100 degrees C. for about 0.25 to 24 hours. Consolidation can be carried out using hot isostatic pressing (HIP'ing) rapid omnidirectional compaction (ROC) or other known techniques. The preferred consolidation technique is that, such as ROC, which has a relatively short preheating and pressure cycle time. Regardless of the consolidation technique employed, it is important that the consolidation temperature be lower than the lowest beta-transus temperature of the alloy(s) used in order to retain the desired microstructure in the consolidated article. Hydrogenated titanium alloy powder has a hydrogenated-beta-transus temperature generally about 100 to 300 degrees C. lower than the normal-beta-transus temperature of an alloy. Thus, for example, if Ti-6Al-4V, which has a normal beta-transus temperature of about 1000 degrees C., is employed for the mounting portion 14, and Ti-6Al-4V powder hydrogenated to about 0.5 to 1.5 weight percent hydrogen, which has a hydrogenated-beta-transus temperature of about 760 to 870 degrees C., is employed for the blade portion 12 in the rotor blade 10, consolidation would be carried out at a temperature below the hydrogenated-beta-transus temperature. In general, consolidation is carried out at a temperature about 25 to 100 degrees C. below the lowest beta-transus temperature. Hydrogen will be retained in the compacted article since the mold 24 is hermetically sealed inside the collapsible vessel.

Following consolidation, the turbine blade 10 is heat treated at a heat treatment temperature greater than the beta-transus temperature of the hydrogenated portion, i.e., the blade portion 12, and less than the beta-transus temperature of the non-hydrogenated portion, i.e., the mounting portion 14. For the alloy Ti-6Al-4V, the heat treatment temperature is between the hydrogenated-beta-transus temperature of about 760 to 870 degrees C. (depending upon the level of hydrogenation), and the normal-beta-transus (i.e., non-hydrogenated-beta-transus) temperature of about 1000 degrees C. The time for heat treatment will vary depending, inter alia, on the cross-section of the article being treated, but in general will be about 15 to 120 minutes. The blade 10 may be heat treated while still in the mold 24, either while inside the aforementioned collapsible vessel or after removal from the collapsible vessel, or after recovery from the mold. The blade 10 is recovered from the mold using techniques known in the art, such as acid etch removal of the mold.

Following heat treatment, the microstructure in the blade portion 12 will be lenticular transformed beta which is highly creep resistant, while the microstructure in the mounting portion will have a typical alpha+beta structure which is highly fatigue resistant.

If the volume of,hydrogenated powder is low in comparison to the total volume of the article, dehydrogenation may not be required inasmuch a the hydrogen in the consolidated hydrogenated powder portion will diffuse into the nonhydrogenated portion(s) of the article. If the resulting overall hydrogen level is below the maximum specification allowable hydrogen level for the alloy(s) (120 ppm) there is no need to sub ject the article to a dehydrogenation step.

If it is desired to dehydrogenate the article, dehydrogenation may be accomplished by heating the article under vacuum to a temperature of about 200to 350 degrees C. below the normal beta-transus temperature of the alloy. The time for hydrogen removal will depend on the size and cross-section of the article, the volume of hydrogen to be removed, the temperature of dehydrogenation and the level of vacuum in the apparatus employed. The term "vacuum" is intended to mean a vacuum of about $10^{-2}$ mm. Hg or less, preferably about $10^{-4}$ mm. Hg or less. The time for dehydrogenation must be sufficient to reduce the hydrogen content in the article to less than the maximum allowable level. For the alloy Ti-6Al-4V. the final hydrogen level must be below about 120 ppm to avoid degradation of mechanical properties. Generally, about 15 to 60 minutes at dehydrogenation temperature and under vacuum, is sufficient to ensure substantially complete evolution of hydrogen from the article.

Titanium alloys which may be employed in the practice of this invention are the alpha+beta alloys. Examples of suitable alloys include Ti-6Al-4V, Ti-6Al-6V-2Sn, Ti-8Mn, Ti-7Al-4Mo, Ti-4.5Al-5Mo-1.5Cr, Ti-6Al-2Sn-4Zr-6Mo, Ti-5Al-2Sn-2Zr-4Mo-4Cr, Ti-6Al-2Sn-2Zr-2Mo-2Cr, Ti-11.5Mo-6Zr-4.5Sn and Ti-3Al-2.5V.

In a presently preferred embodiment of the invention, the powder is hydrogenated to a level of about 0.1 to 4.0 weight percent hydrogen, preferably about 0.5 to 1.5 weight percent hydrogen, prior to use in the present invention. Any conventional technique may be used for producing hydrogenated titanium alloy powder. For example, bulk alloy articles can be hydrogenated to provide an embrittled article which can then be crushed to powder. Alternatively, hydrogenated titanium alloy powder may be produced according to the technique set forth in Cloran et al, U.S. Pat. No. 4,009,233, which comprises the steps of hydrogenating at least a surface portion of an alloy article, locally melting the hydrogenated portion in a hydrogen-containing atmosphere and cooling the droplets produced at a rate sufficient to form discrete particles. The powder material must be protected from oxidation and contamination during storage.

FIGS. 3 and 4 illustrate another aspect of the first embodiment of the present invention. Referring now to the drawing. FIG. 3 illustrates a gear wheel 40 consisting of a circular disk 42 with a centered hole 44, for mounting gear 40 to a shaft, and a concentric gear ring 46 having a plurality of gear teeth 48 suitably spaced around the periphery of ring 46. The demarcation line 50 between disk 42 and ring 46 is for illustration only and would not be apparent in a finished gear wheel.

Referring to FIG. 4, the mold is a can mold having a body 52 and a lid 54. Body 52 has a lip 56 for later sealing the lid 54 to body 52. It should be understood that the mold shown in FIG. 2 does not include allowance for packing of the alloy powder used.

A blank 42, such as a disk cut from a wrought cylinder or a cast piece, is placed, centered, in the mold body 52. The mounting hole 44 may be drilled through the disk 42 prior to fabrication of the gear, as shown, or drilled after completion. The space 58 in the mold body defining the gear ring and gear teeth is filled with a hydrogenated titanium alloy powder. The mold is sealed, as by evacuating the mold, then placing the lid 54 on the body 52 and crimping or welding the lid to the lip 56. The gear is then consolidated and heat treated as described previously.

Following heat treatment, the microstructure in the ring portion 46 will be lenticular transformed beta, while the microstructure in the disk 42 will have a typical alpha+beta structure.

It is also within the scope of this invention to modify the microstructure of previously fabricated titanium alloy articles so that the resulting articles have at least two regions, each region having a distinct microstructure. Such articles may be fabricated by casting, powder metallurgy, forging or the like.

In one aspect, the previously fabricated article is selectively hydrogenated, i.e., hydrogenated in selected portions or regions of the article, heated to a temperature between the hydrogenated-beta-transus temperature of the hydrogenated portion(s) of the article and the normal-beta-transus temperature of the non-hydrogenated portion(s) of the article, and then dehydrogenated, if desired, as described previously.

Selective hydrogenation of the article is accomplished by masking the protion(s) of the article which is/are not to be hydrogenated, then hydrogenating the non-masked portion(s). Masking can be accomplished for example, by sputtering a metal, such as carbon steel or iron, onto the surface to be masked, through a simple negative sputtering mask. The sputtered mask can later be removed by, for example, acid etching. Alternatively, portions of the article can be masked by applying thereto a relatively low melting glass or glass-like material and heating to fuse the material. An example of such a material is borax, either alone or in admixture with silica. This mask will later be simply chipped off the surface.

The thus-masked article is then hydrogenated to a desired level of hydrogen, using known techniques. Typically. hydrogenation is carried out in a suitable, closed apparatus at a temperature about 50% to 96% of the normal beta-transus temperauure of the alloy. The article is heated to hydrogenation temperature in an inert atmosphere. Hydrogen is then introduced into the atmosphere within the apparatus. The partial pressure of hydrogen added to the atmosphere and the time required for hydrogenation are dependent upon factors such as the size and cross-section of the article, temperature of hydrogenation and the desired concentration of hydrogen in the article. The atmosphere within the apparatus is flushed with a non-flammable mixture of an inert gas and about 4 hydrogen.

The masked, partially hydrogenated article is heated to a temperature between the hydrogenated-beta-transus temperature of the hydrogenated portion(s) of the article and the normal-beta-rransus temperature of the non-hydrogenated portion(s) of the article, as described previously. The time for heat treatment is, generally, about 15 to 120 minutes.

If the volume of the hydrogenated portions(s) is low in comparison to the total volume of the article, dehydrogenation may not be required inasmuch as the hydrogen in the hydrogenated portion(s) will diffuse into the non-hydrogenated portion(s) of the article. If the resulting overall hydrogen level is below the maximum specification allowable hydrogen level for the alloy (120 ppm), there is no need to subject the article to a dehydrogenation step. If it is desired to dehydrogenate the article, dehydrogenation may be accomplished as described previously.

Following heat treatment, the microstructure in the hydrogenated portion(s) will be lenticular transformed beta, while the remainder will have a typical alpha+-beta structure.

In another aspect, the previously fabricated article is hydrogenated to a desired level of hydrogen, as described above, then locally heat treated in one or more regions of the article. The hydrogenated article is first heated to a temperature below the hydrogenated-beta-transus temperature of the ar icle and then locally heated to a temperature above the hydrogenated-beta-transus temperature. Such local heating may be accomplished using induction heating, focused infra-red heating, or laser heating. The article may be dehydrogenated as described previously.

Following heat treatment, the microstructure in the locally heated region(s) will be lenticular transformed beta, while the remainder will have a typical alpha+-beta structure.

Various modifications may be made in the present invention without departing from the spirit of the invention or the scope of the appended claims.

We claim:

1. A method for producing an integral titanium alloy article having at least two regions, each region having a distinct microstructure, which comprises the steps of (a) providing a suitable mold for the article;

(b) introducing a first, non-hydrogenated titanium alloy in powder form into a first portion of said mold;

(c) introducing a second, hydrogenated titanium alloy in powder, form into a second portion of said mold;

(d) hot compacting said first and second alloys in said mold to produce a substantially fully dense article;

(e) heating the resulting article to a temperature between the beta-transus temperatures of the two alloys; and, (f) cooling the thus-heated article.

2. The method of claim 1 wherein said second alloy is hydrogenated to a level of about 0.1 to 4.0 weight percent hydrogen.

3. The method of claim 1 wherein said second alloy is hydrogenated to a level of about 0.5 to 1.5 weight percent hydrogen.

4. The method of claim 1 wherein said first and second alloys are compacted in said mold at a temperature about 25°-100° C. below the beta transus temperature of said hydrogenated second alloy.

5. The method of claim 1 further comprising the step of dehydrogenating the cooled article.

6. The method of claim 2 wherein said first alloy is Ti-6Al-4V and said second alloy is Ti-6Al-4V.

7. The method of claim 3 wherein said first alloy is Ti-6Al-4V and said second alloy is Ti-6Al-4V.

8. The method of claim 5 wherein said article is dehydrogenated at a temperature about 200°-300° C. below the lower of the normal beta transus temperatures of said alloys.

9. A method for producing an integral titanium alloy article having at least two regions, each region having a distinct microstructure, which comprises the steps of (a) providing a suitable mold for said article;

(b) introducing a first, non-hydrogenated titanium alloy in solid form into a first portion of said mold;

(c) introducing a second, hydrogenated titanium alloy in powder form into a second portion of said mold;

(d) hot compacting said first and second alloys in said mold to produce a substantially fully dense article;

(e) heating the resulting article to a temperature between the beta-transus temperatures of the two alloys; and, (f) cooling the thus-heated article.

10. The method of claim 9 wherein said second alloy is hydrogenated to a level of about 0.1 to 4.0 weight percent hydrogen.

11. The method of claim 9 wherein said second alloy is hydrogenated to a level of about 0.5 to 1.5 weight percent hydrogen.

12. The method of claim 9 wherein said first and second alloys are compacted in said mold at a temperature about 25°-100° C. below the beta transus temperature of said hydrogenated second alloy.

13. The method of claim 9 further comprising the step of dehydrogenating the cooled article.

14. The method of claim 10 wherein said first alloy is Ti-6Al-4V and said second alloy is Ti-6Al-4V.

15. The method of claim 11 wherein said first alloy is Ti-6Al-4V and said second allo is Ti-6Al-4V.

16. The method of claim 13 wherein said article is dehydrogenated at a temperature about 200°-300° C. below the lower of the normal beta transus temperatures of said alloys.

* * * * *

UNITED STATES PATENT AND TRADEMARK OFFICE

CERTIFICATE OF CORRECTION

PATENT NO. : 4,808,249

DATED : February 28, 1989

INVENTOR(S) : Daniel Eylon et al

It is certified that error appears in the above-identified patent and that said Letters Patent is hereby corrected as shown below:

Col 1, line 20, "airlanes" should be ---airplanes---.
Col 1, line 37, "resistance." should be ---resistance,---.
Col 3, line 18, "regions. each" should be ---regions, each---.
Col 3, line 23, "2." should be ---2,---.
Col 3, lines 54-55, "minimallY" should be ---minimally---.
Col 4, line 8, correct the spelling of "outgassing".
Col 4, line 68, "inasmuch a" should be ---inasmuch as---.
Col 5, line 5, "sub ject" should be ---subject---.
Col 5, line 9, "200to 350" should be ---200 to 350---.
Col 5, line 20, "Ti-6Al-4V." should be ---Ti-6Al-4V,---.
Col 5, line 53, "drawing." should be ---drawing,---.
Col 6, line 29, after "accomplished" should be a comma ---,---.
Col 6, line 42, "Typically." should be ---Typically,---.
Col 6, line 54, "4 hydrogen" should be ---4% hydrogen---.
Col 7, line 14, "ar icle" should be ---article---.

Signed and Sealed this

Twenty-fourth Day of October, 1989

*Attest:*

*Attesting Officer*

DONALD J. QUIGG

*Commissioner of Patents and Trademarks*